US006332872B1

(12) United States Patent
Young

(10) Patent No.: US 6,332,872 B1
(45) Date of Patent: Dec. 25, 2001

(54) PORTABLE CARDIOPULMONARY RESUSCITATION DEVICE WITH PRECISE COMPRESSION DEPTH AND UNIFORMITY

(76) Inventor: Charles Young, 121 N. Almansor St., Alhambra, CA (US) 91801

( * ) Notice: Subject to any disclaimer, the term of this patent is extended or adjusted under 35 U.S.C. 154(b) by 0 days.

(21) Appl. No.: 09/603,348

(22) Filed: Jun. 26, 2000

(51) Int. Cl.[7] ..... A61H 31/00
(52) U.S. Cl. ..... 601/41; 601/107
(58) Field of Search ..... 601/41, 97, 107, 601/108

(56) References Cited

U.S. PATENT DOCUMENTS

| | | | | |
|---|---|---|---|---|
| 3,078,843 | * | 2/1963 | Brisson | 128/52 |
| 3,739,771 | * | 6/1973 | Gaquer et al. | 128/51 |
| 3,782,371 | * | 1/1974 | Derouineau | 128/28 |
| 4,686,968 | * | 8/1987 | Scherger | 128/72 |
| 5,184,606 | * | 2/1993 | Csorba | 128/28 |

* cited by examiner

*Primary Examiner*—Justine R. Yu
(74) *Attorney, Agent, or Firm*—Dougherty & Troxell

(57) ABSTRACT

Portable cardiopulmonary resuscitation device with precise compression depth and uniformity, including a frame body and a compression mechanism associate with the frame body. The compression mechanism includes a handle and a connecting bar connected between the handle and a coupling seat. An adjusting bolt is passed through the coupling seat and movably screwed in a locating block. At least one movable sleeve is disposed on one side of, above or below the locating block. The movable sleeve slide along a retaining shaft which is vertically jointed to a fixing frame. A lower end of adjusting bolt is connected with a plunger. The other end of the coupling seat is further connected with another connecting bar which is connected to the frame body. Two sitting bars are connected between the two transverse beams of the frame body. When rescuing a victim, a rescuer can sit on the sitting bars with the rescuer's weight offsetting a reaction force produced in compression of the heart. The frame body can be associated with a base board which is fixed on an emergency litter, enabling a rescuer to perform cardiopulmonary resuscitation in a moving ambulance.

10 Claims, 6 Drawing Sheets

PORTABLE CARDIOPULMONARY RESUSCITATION DEVICE WITH PRECISE COMPRESSION DEPTH AND UNIFORMITY

BACKGROUND OF THE INVENTION

The present invention relates to a portable cardiopulmonary resuscitation device with precise compression depth and uniformity, and more particularly to a cardiopulmonary resuscitation device by which the compression depth is settable. With the cardiopulmonary resuscitation device, the chest compression can be precisely performed at the preset compression depth by a less experienced or non-expert person. Also, the chest compression can be performed in a running ambulance when transferring a victim. The cardiopulmonary resuscitation device is composed of few components and has a light weight structure so that it can be easily carried and the manufacturing cost of the cardiopulmonary resuscitation device is relatively low.

The compression stroke depth is critical in cardiopulmonary resuscitation chest compression. For example, the stoke depth is generally 2 inches for an adult and 1.5 inches for a child. Numerous cardiopulmonary resuscitation (CPR) devices have heretofore been proposed. A major disadvantage of many of these is that no provision is made for applying the exact and repeatable compression stroke depth which are recommended by the American Heart Association.

This problem has heretofore been recognized and several attempts have been made to solve it. For example, U.S. patent Ser. No. 05/589,639 discloses the use of electrical sensor to determine the force applied when victim's chest is being compressed. The amount of force exerted onto victim did not correspond exactly to the stroke depth acquired. The deciding factor is the stroke depth, not the force applied.

U.S. Pat. No. 4,019,501 discloses the use of fluid pressure gauge to determine the force applied but not the compression stoke depth acquired.

U.S. patent Ser. No. 05/645,522 also discloses the use of pressure sensing instrument to determine the force applied.

Other patents resulted from a patent search include:

U.S. Pat. Nos. 5,634,886, 5,327,887 and Ser. No. 65/295, 481.

SUMMARY OF THE INVENTION

It is therefore a primary object of the present invention to provide a portable cardiopulmonary resuscitation device with precise compression depth and uniformity, which includes a frame body and a compression mechanism. The compression mechanism has a handle connected with a connecting bar for operating a plunger. A depth controlling scale is disposed on the frame body for presetting the compression depth of the plunger. Therefore, even a less experienced or non-expert person can perform chest compression at a precise depth.

It is a further object of the present invention to provide the above portable cardiopulmonary resuscitation device which is composed of few components so that the total weight of the cardiopulmonary resuscitation device is reduced and easy to carry . In addition, a rescuer can sit on the sitting bars of the frame body with the weight of the rescuer offsetting the reaction force produced during compression of the heart. Therefore, the heavy platform is unnecessary and it is no need to relocate the victim to the space under the frame body. Instead, the CPR device can be directly placed on the victim. This saves rescue time and efforts.

It is still a further object of the present invention to provide the above portable cardiopulmonary resuscitation device, in which the compression depth can be adjusted and presetted.

It is a further object of the present invention to provide the above portable cardiopulmonary resuscitation device, in which the compression mechanism can be kept operating in a perpendicular direction.

It is still a further object of the present invention to provide the above portable cardiopulmonary resuscitation device in which a base board can be added for fixing the frame body thereon. The base board can be secured on an ambulance cot. Accordingly, the cardiopulmonary resuscitation can be also performed in a moving ambulance.

According to the above objects, the portable cardiopulmonary resuscitation device according to the present invention includes a frame body and a compression mechanism associate with the frame body. The frame body is composed of two transverse beams and two U-shaped bars which are perpendicularly connected with the transverse beams to form the frame body with four supporting legs. The compression mechanism includes a connecting bar one end of which is pivotally connected with one of the transverse beams of the frame body, while the other end of which is a free end connected with a handle positioned above the other transverse beam for up and down movement and operation. The other transverse beam serves as a stopper for stopping the pressed down connecting bar. A set of movable sleeve and retaining shaft are disposed on at least one side of or above or below the connecting bar. The movable sleeve, such as a linear bearing, is fitted around the vertical retaining shaft and restricted thereby to move only up and down. The movable sleeve is connected with the connecting bar, while the vertical retaining shaft is fixed on the frame body via a fixing frame and bridge bars so as to ensure up and down movement of the connecting bar. A compression depth adjusting mechanism is disposed on the connecting bar for adjusting the compression depth of the connecting bar. A lower end of the compression depth adjusting mechanism is connected with a plunger for compressing the heart portion of a victim. Two sitting bars are connected between the two transverse beams of the frame body. When rescuing a victim, a rescuer can sit on the sitting bars with the rescue's weight offsetting a reaction force produced in compression of the heart. The frame body can be associated with a base board which is fixed on an emergency litter, enabling a rescuer to perform cardiopulmonary resuscitation in a moving ambulance.

The present invention can be best understood through the following description and accompanying drawings wherein:

DETAILED DESCRIPTION OF THE PREFERRED EMBODIMENTS

Figure 1:
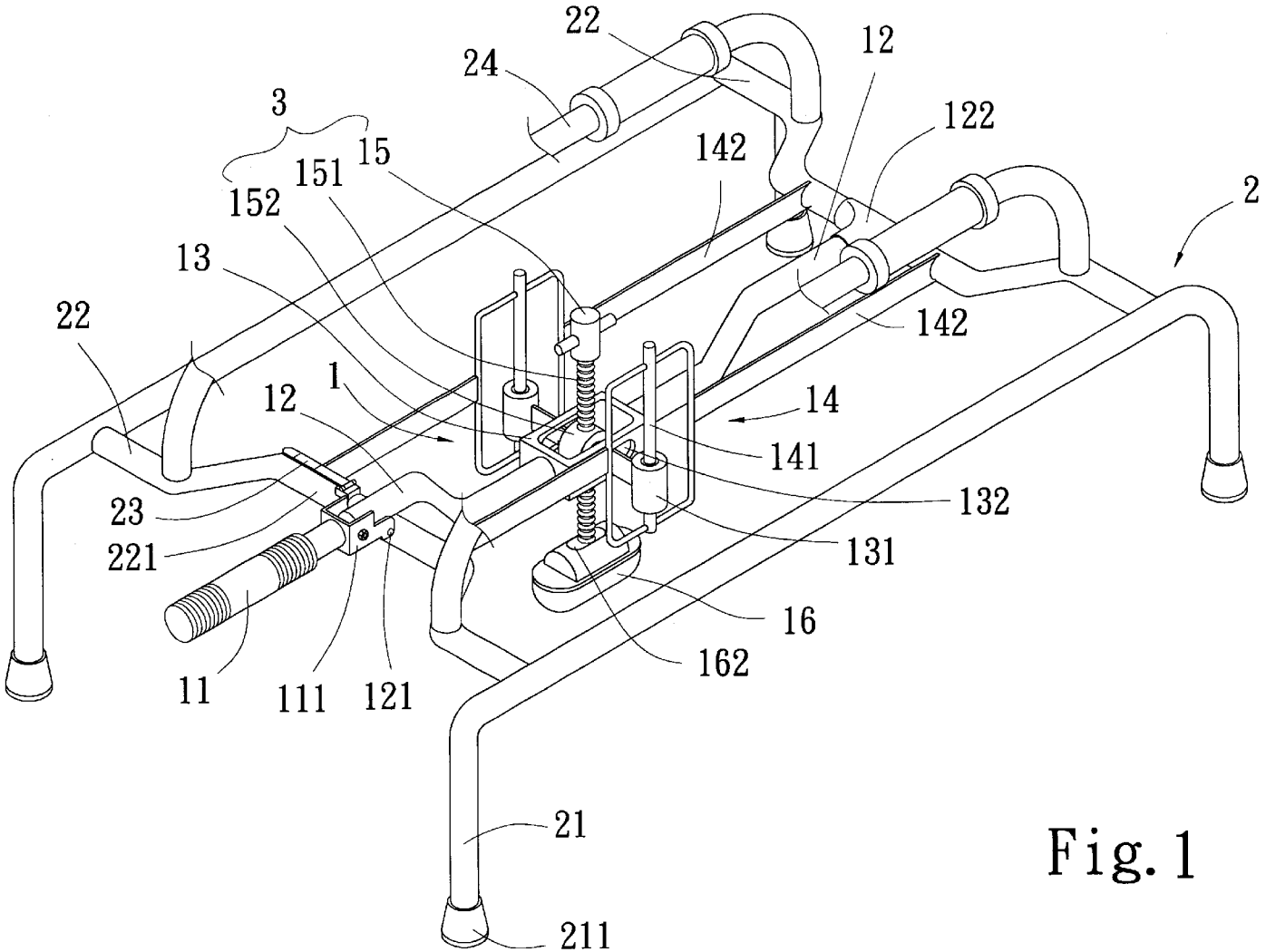
FIG. 1 is a perspective assembled view of the cardiopulmonary resuscitation device of the present invention.
Figure 2B:
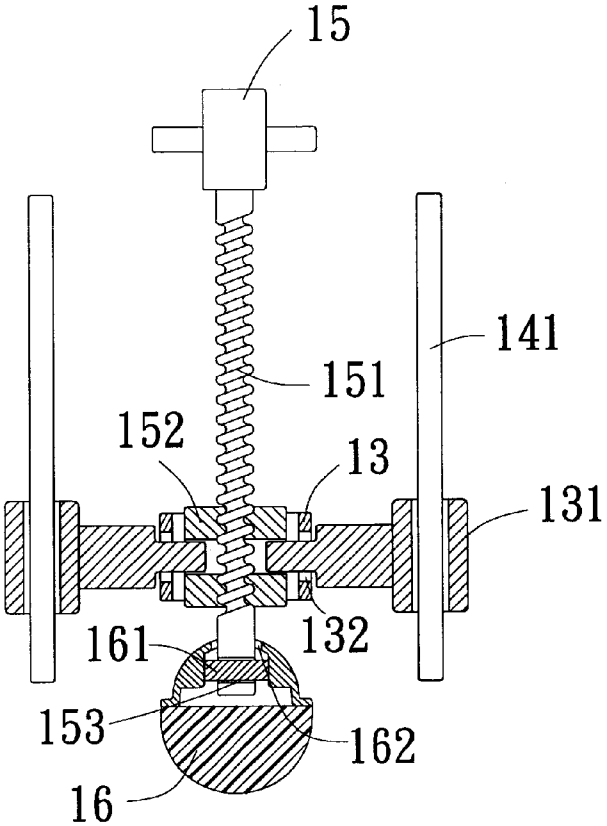
FIGS. 2*a* and 2*b* are sectional views showing the adjustment of the plunger of the cardiopulmonary resuscitation device of the present invention.
Figure 2A:
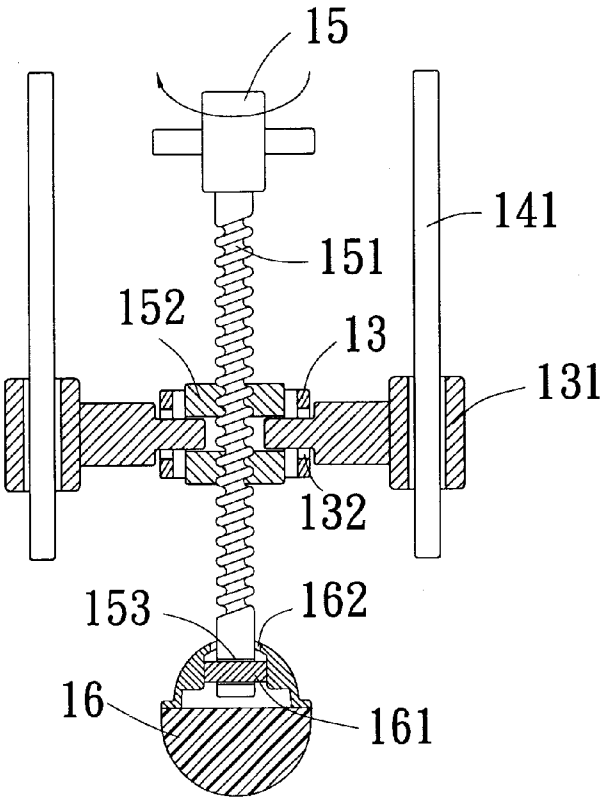
Figure 3A:
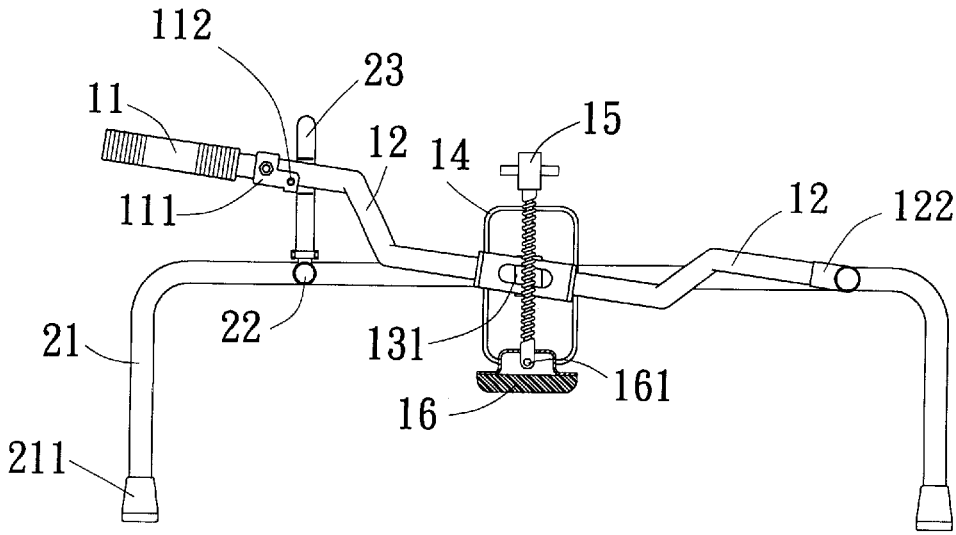
FIGS. 3*a* and 3*b* show the operation of the cardiopulmonary resuscitation device of the present invention.
Figure 3B:
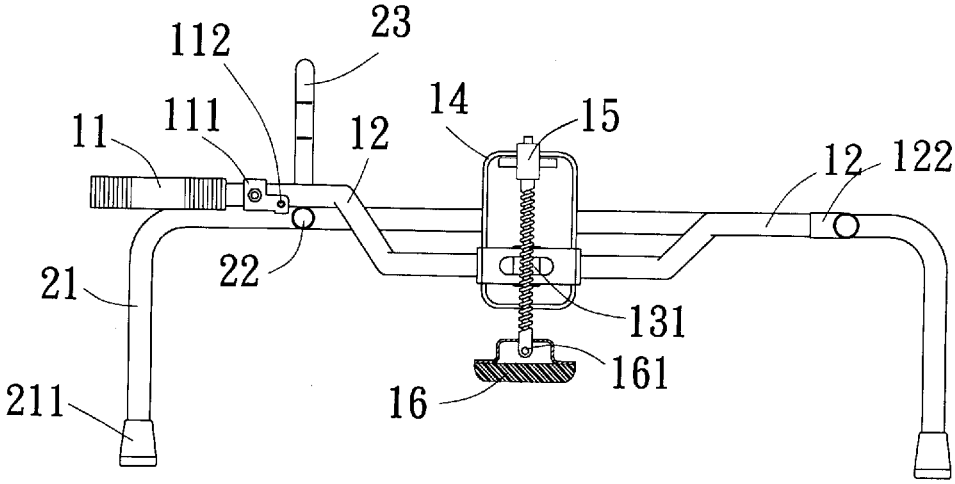
Figure 4:
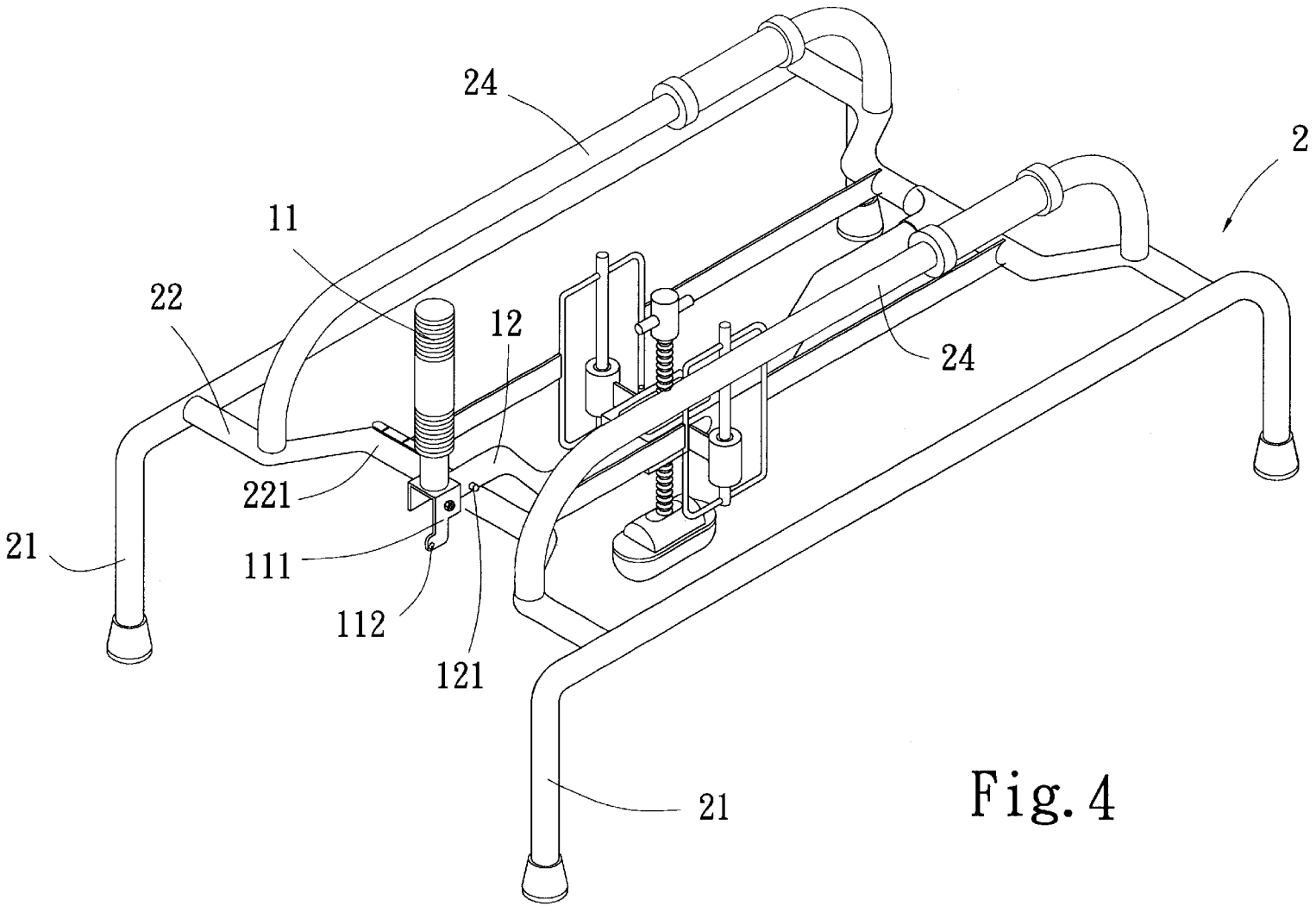
FIG. 4 is a perspective view showing that the handle of the cardiopulmonary resuscitation device of the present invention is pivoted up.

Please refer to FIGS. 1 and 2*a*. The portable cardiopulmonary resuscitation (CPR) device with precise compression depth and uniformity according to the present invention includes a compression mechanism 1 and a frame body 2. The frame body 2 is composed of two transverse beams 22 and two U-shaped bars which are perpendicularly connected with the transverse beams 22 to form the frame body 2 with four supporting legs 21. The bottom end of each supporting leg 21 is disposed with a pad member 211. Two sitting bars 24 are symmetrically connected between the two transverse beams 22. A depth controlling scale 23 is positioned above one transverse beam 22 having a bending section 221.

The compression mechanism 1 includes a handle 11 having a fitting section 111 at front end. The fitting section 111 is pivotally connected with a connecting bar 12. The front end of the fitting section 111 is formed with a locking hole 112 in which a resilient buckle 121 of the connecting bar 12 is locked. The connecting bar 12 is coupled with a coupling seat 13. An adjusting bolt 15 is perpendicularly passed through the coupling seat 13. A thread section 151 of the adjusting bolt 15 is movably screwed in a locating block 152, i.e. nut. At at least one side of, above or below the locating block 152 is connected with a movable sleeve 131, e.g. linear bearing, in which an upright retaining shaft 141 of a fixing frame 14 is fitted. Two sides of the fixing frame 14 are respectively connected with two bridge bars 142 interconnected between the fixing frame 14 and the transverse beam 22. The lower end of adjusting bolt 15 is formed with a through hole 153 and passed through a cavity 162 of upper side of a plunger 16. A shaft rod 161 of the plunger 16 is passed through the through hole 153 to pivotally connect the plunger 16 with the adjusting bolt 15. The other end of the coupling seat 13 is connected with another connecting bar 12 which is connected to a pivotable tube 122 pivotably fitted on the transverse beam 22.

Referring to FIGS. 1, 2*a*, 2*b*, 3*a* and 3*b*, the present invention is characterized in that by means of the depth controlling scale 23 arranged above the transverse beam 22, the compression depth can be first set. Accordingly, even a less experienced or non-expert person is able to precisely perform the compression operation. In accordance with the contour of the compressed part of a victim, the adjusting bolt 15 is first rotated to ascend/descend the thread section 151 thereof through the locating block 152. The plunger 16 is pivotally connected with the adjusting bolt 15 by the shaft rod 161 so that the plunger 16 can be accommodated to the compressed part of the victim. The retaining shafts 141 of the fixing frames 14 are fitted in the movable sleeves 131 on two sides of the locating block 152 so that the compression operation is kept vertically performed. The rescuer can sit on the sitting bars 24between the transverse beams 22, whereby the weight of the rescuer can offset the reaction force produced during compression of the heart. Therefore, a heavy platform is unnecessary and the total weight and size of the CPR device are reduced.

Referring to FIGS. 3*a*, 3*b*, 4 and 6, in use of the CPR device, the depth controlling scale 23 is positioned upright. Then the upper edge of the connecting bar 12 of the handle 11 is aligned with the compression depth scale marked on the depth controlling scale 23 so as to set up the compression depth. Then the adjusting bolt 15 is rotated to attach the plunger to the compressed part of the victim. Finally the handle 11 is pressed down to make the movable sleeves 131 vertically slide along the retaining shafts 141 of the fixing frames 14 for compression operation. Each time the handle 11 is pressed down to touch the transverse beam 22 and stop, the compression depth is right the set depth. When rescuing a victim, the resilient buckle 121 of the connecting bar 12 can be depressed and released from the locking hole 112 of the front end of the fitting section 111. At this time, the handle 11 can be positioned upright and via the bending section 221 of the transverse beam 22, a rescuer is able to conveniently perform artificial respiration for the victim.

In the above embodiment, the adjusting bolt 15 with the thread section 151 is screwed up and down along the locating block 152 such as a nut to adjust the compression depth of the connecting bar 12 of the compression mechanism 1. Therefore, the compression depth adjusting mechanism 3 is formed by a mechanical device for elevating and descending , such as the adjusting bolt 15 and the locating block 152. However, the compression depth adjusting mechanism can be alternatively formed by an hydraulic or pneumatic measure.

Figure 5:
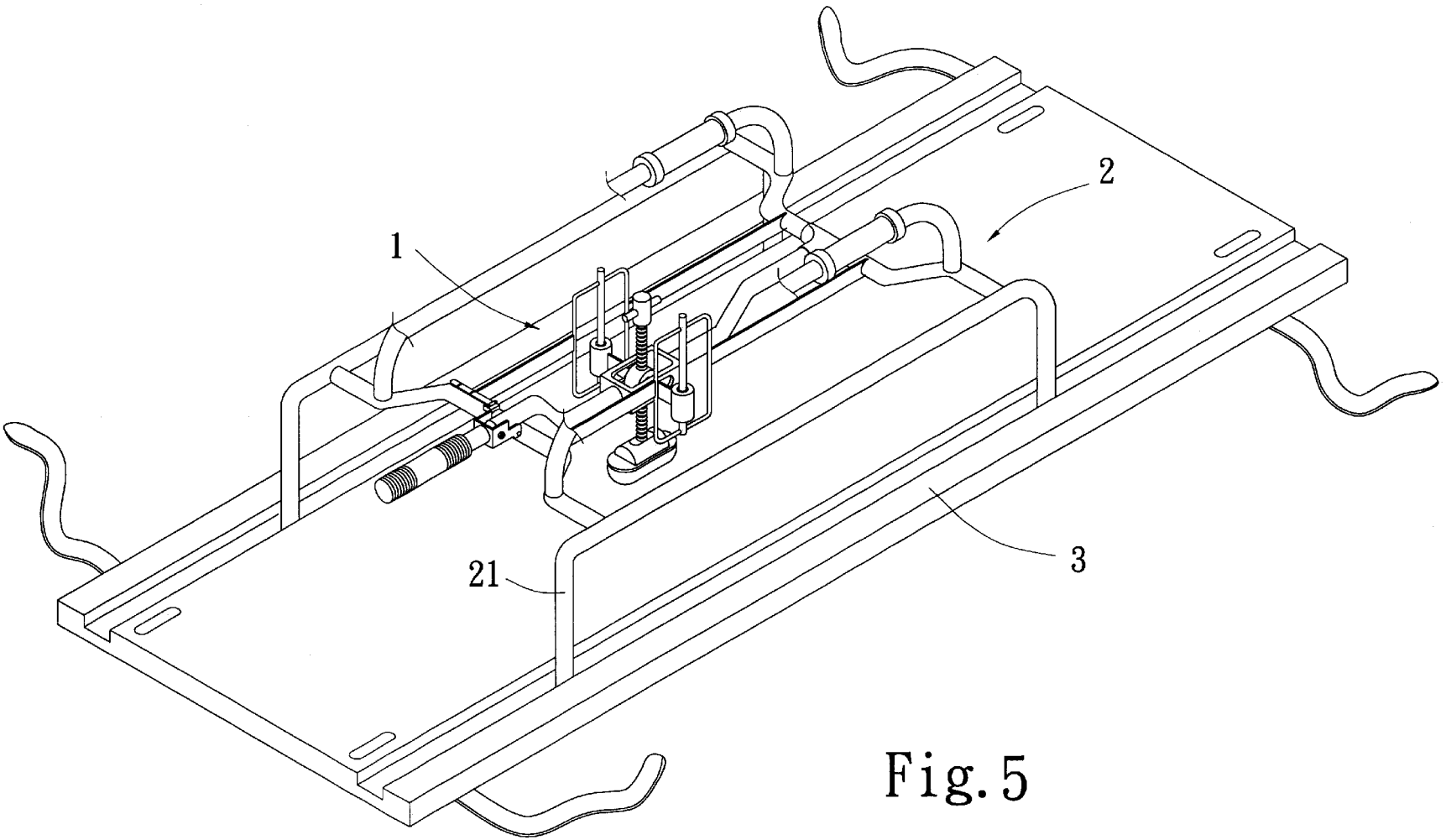
FIG. 5 is a perspective view showing another embodiment of the cardiopulmonary resuscitation device of the present invention fitted with a base board.
Figure 6:
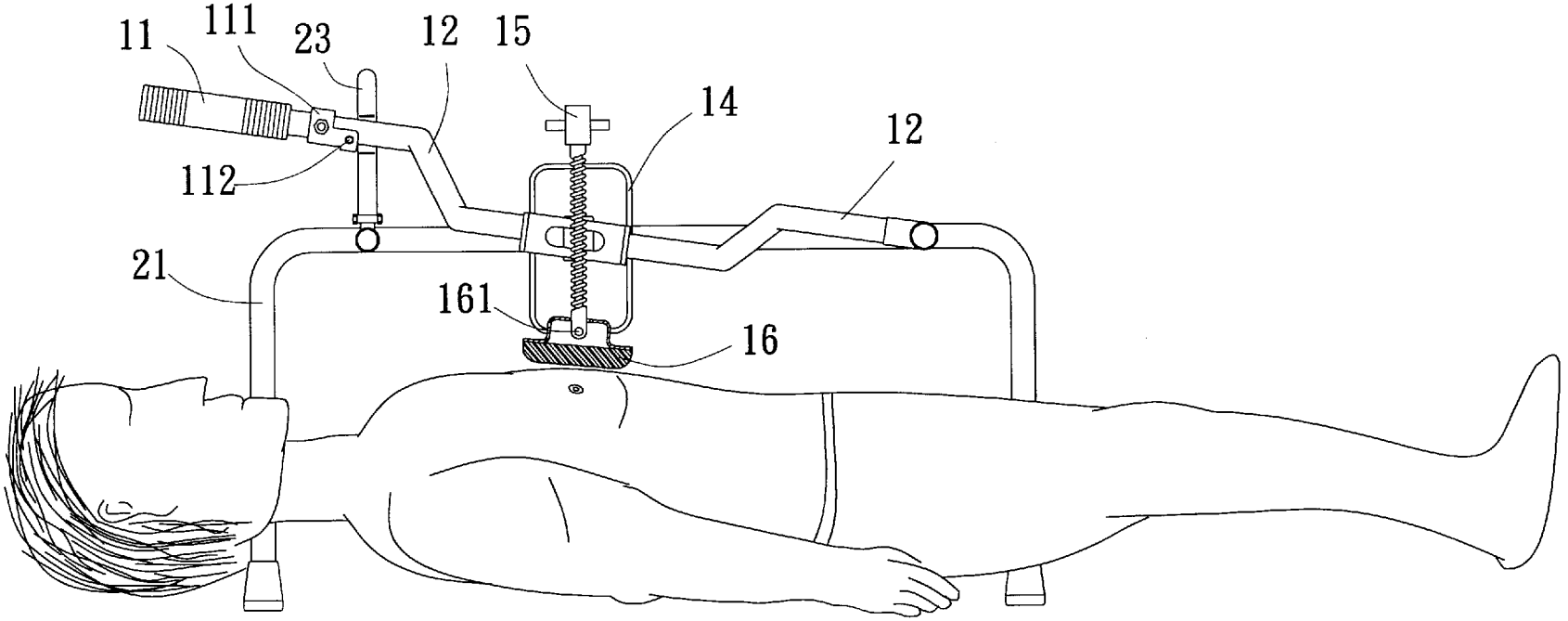
FIG. 6 shows the position relationship between a victim and the cardiopulmonary resuscitation device of the present invention.

Referring to FIG. 5, when used in an ambulance, a base board 3 is connected to the respective supporting legs 21 of the frame body 2 and the victim can be secured on the base board 3. The base board 3 can be fixed on an emergence litter by fastening straps. Accordingly, the present invention is applicable to the emergency litter in a moving car while the victim is being transferred.

Referring to FIGS. 3*a*, 3*b*, 4, 5 and 6, after the compression mechanism and the frame body are associated, the CPR device can be used for compression operation. In addition, an air supplying system can be arranged under the handle. The air supplying system is composed of a pump, an air reservoir, a respiration cup and a connecting hose. The pump is connected with the handle of the compression mechanism. When the handle is pressed downward, the pump at the same time inputs air into the air reservoir for reserving the air. By means of pressing a press button for controlling a valve, the air can be released and conducted through the connecting hose to the respiration cup and enter the lungs of the victim. Accordingly, the compression operation and air supplying operation can be alternately performed.

According to the above arrangement, the present invention has the following advantages:

1. By means of the depth controlling scale disposed above the transverse beam, the proper compression depth can be previously set up. Therefore, even a less experienced or non-expert person can perform precise compression operation. This ensures a precise compression depth and thus avoids injury caused by improper compression.
2. The adjusting bolt is movable screwed in the locating block in such a manner that the movable sleeves on two sides of the locating block vertically movably slide along the retaining shafts which are vertically jointed to two fixing frames respectively. Therefore, the compression is kept performing in a perpendicular direction.
3. The rescuer can sit on the sitting bars of the frame body of the present invention, whereby the weight of the rescuer can offset the reaction force produced during compression of the heart. Therefore, the heavy platform is unnecessary and it is no need to move the victim to the space under the frame body. Instead, the CPR device can be directly placed on the victim. This saves rescue time and efforts.
4. A base board can be added to the CPR device of the present invention for fixing the frame body thereon. The base board can be secured on an ambulance cot. Accordingly, the cardiopulmonary resuscitation can be also performed in a running ambulance without improper compression operation.
5. The present invention is composed of few components and materials so that the total weight of the CPR device is reduced, and as a result, the CPR device is portable and can be used more conveniently.

6. The present invention is composed of few components and materials so that the manufacturing cost is greatly lowered.

The above embodiments are only used to illustrate the present invention, not intended to limit the scope thereof. Many modifications of the above embodiments can be made without departing from the spirit of the present invention.

What is claimed is:

1. Portable cardiopulmonary resuscitation device with precise compression depth and uniformity, comprising:

a frame body composed of two transverse beams and two U-shaped bars which are perpendicularly connected with the transverse beams to form the frame body with four supporting legs; and a compression mechanism including a connecting bar, one end of which is pivotally connected with one of the transverse beams of the frame body, while the other end of which is a free end connected with a handle positioned above the other transverse beam for up and down movement and operation, a set of movable sleeve and retaining shaft being disposed on at least one side of, above or below the connecting bar, the movable sleeve being fitted around the vertical retaining shaft and restricted thereby to only move up and down, the movable sleeve being connected with the connecting bar, while the vertical retaining shaft being fixed on the frame body via a fixing frame and bridge bars so as to ensure up and down movement of the connecting bar, a compression depth adjusting mechanism being disposed on the connecting bar, a lower end of the compression depth adjusting mechanism being connected with a plunger for pressing the heart of the person who needs the operation, wherein, the compression depth of the plunger is controlled and adjusted by a mechanical device for elevating and descending, hydraulic measure or pneumatic measure, one of the transverse beams of the frame body serving as a stopper for restricting the compression depth of the connecting bar and the plunger and avoiding over-compression of the heart.

2. Portable cardiopulmonary resuscitation device with precise compression depth and uniformity as claimed in claim 1, wherein the compression depth adjusting mechanism includes a hollow coupling seat disposed on the connecting bar, a locating block formed with inner thread and fixed in the coupling seat, an adjusting bolt movably screwed in the locating block, a bottom end of the adjusting bolt being connected with the plunger, thereby forming mechanical device for elevating and descending the plunger.

3. Portable cardiopulmonary resuscitation device with precise compression depth and uniformity as claimed in claim 1, wherein the frame body is associated with a base board which is fixed on an ambulance cot, enabling a rescuer to perform cardiopulmonary resuscitation in a running ambulance.

4. Portable cardiopulmonary resuscitation device with precise compression depth and uniformity as claimed in claim 1, wherein a front end of the handle is disposed with a fitting section pivotally connected with the connecting bar, a front end of the fitting section being formed with a locking hole in which a resilient buckle of the connecting bar is locked, whereby when the buckle is unlocked from the locking hole, the handle can be pivoted to facilitate artificial respiration operation.

5. Portable cardiopulmonary resuscitation device with precise compression depth and uniformity as claimed in claim 1, wherein a lower end of adjusting bolt is pivotally connected with the plunger, whereby the plunger is able to tilt and snugly attach to a compressed part of a victim.

6. Portable cardiopulmonary resuscitation device with precise compression depth and uniformity as claimed in claim 1, wherein an air supplying system is arranged under the handle, the air supplying system being composed of a pump, an air reservoir, a respiration cup and a connecting hose, the pump being connected with the handle of the compression mechanism, whereby when the handle is pressed downward, the pump at the same time inputs air into the air reservoir for reserving the air, by means of pressing a press button for controlling a valve, the air being released and conducted through the connecting hose to the respiration cup and entering the lungs of a victim, whereby the compression operation and air supplying operation are alternately performed.

7. Portable cardiopulmonary resuscitation device with precise compression depth and uniformity as claimed in claim 1, wherein a depth controlling scale is arranged above the transverse beam beside the handle for setting compression depth.

8. Portable cardiopulmonary resuscitation device with precise compression depth and uniformity as claimed in claim 1, wherein the transverse beam beside the handle is formed with an inward bending section, whereby when the handle is upward pivoted, an enlarged space for artificial respiration is provided.

9. Portable cardiopulmonary resuscitation device with precise compression depth and uniformity as claimed in claim 1, wherein two sitting bars are connected between the two transverse beams of the frame body, whereby when rescuing a victim, a rescuer can sit on the sitting bars with the rescuer's weight offsetting a reaction force produced in compression of the heart.

10. Portable cardiopulmonary resuscitation device with precise compression depth and uniformity as claimed in claim 1, wherein a pivotable tube is fitted on the transverse beam of the frame body for connecting the compression mechanism with the frame body.

* * * * *